US006059221A

United States Patent [19]

Broger et al.

[11] Patent Number: 6,059,221

[45] **Date of Patent: *May 9, 2000**

[54] APPARATUS FOR CHANGING A LAP

[75] Inventors: David Broger, Sirnach; Heinz Clement, Winterthur, both of Switzerland

[73] Assignee: Rieter Machine Works, Ltd., Winterthur, Switzerland

[ * ] Notice: Under 35 U.S.C. 154(b), the term of this patent shall be extended for 848 days.

[21] Appl. No.: 08/611,416

[22] Filed: Mar. 5, 1996

Related U.S. Application Data

[63] Continuation of application No. 08/135,684, Oct. 13, 1993, abandoned.

[30] Foreign Application Priority Data

Oct. 16, 1992 [CH] Switzerland ..... 03229/92

[51] Int. Cl.[7] ..... B65H 19/00

[52] U.S. Cl. ..... 242/559.1

[58] Field of Search ..... 242/559.1, 559.2, 242/559.3, 558, 561, 533.2, 533.3, 35.5 A; 414/910, 911

[56] References Cited

U.S. PATENT DOCUMENTS

| | | | |
|---|---|---|---|
| 3,904,050 | 9/1975 | Kimura et al. | 242/533.3 X |
| 4,005,830 | 2/1977 | Smith | 242/559.1 X |
| 4,298,173 | 11/1981 | Johansson | 242/558 |
| 5,096,135 | 3/1992 | Aichenberger et al. | 242/559.1 X |

FOREIGN PATENT DOCUMENTS

| | | |
|---|---|---|
| 0349852 | 1/1990 | European Pat. Off. . |
| 0437807 | 7/1991 | European Pat. Off. . |
| 0452491 | 10/1991 | European Pat. Off. . |
| 0455171 | 11/1991 | European Pat. Off. . |
| 0890150 | 10/1943 | France . |
| 3836242 | 4/1990 | Germany . |
| 52-64823 | 5/1977 | Japan . |
| 59-43386 | 12/1984 | Japan . |
| 63-27449 | 6/1988 | Japan . |
| 0825734 | 12/1959 | United Kingdom . |
| 0953405 | 3/1964 | United Kingdom . |

OTHER PUBLICATIONS

Rieter Machine Works, Ltd, Brochure, Imprint 1403f–0991.

*Primary Examiner*—John Q. Nguyen

*Attorney, Agent, or Firm*—McAulay Nissen Goldberg Kiel & Hand, LLP

[57] ABSTRACT

The apparatus for receiving and forwarding a reserve lap roll employs a trough to receive the lap roll and pivotally mounted arms for pivoting the trough from the reserve position toward the working position. The arms may be pivoted by a piston and cylinder unit. Alternatively, a parallelogram arrangement of guide rods may be used for moving the trough from the reserve position toward the working position. In still another embodiment, pairs of pivotally mounted arms can be used to move the reserve lap roll from the reserve position directly into the working position. In each embodiment, the pivotal elements are spaced apart a distance greater than the length of an empty tube in the working position so that the empty tube can be ejected through the space between the arms to a position below the reserve position.

3 Claims, 7 Drawing Sheets

APPARATUS FOR CHANGING A LAP

This is a continuation of application Ser. No. 08/135,684 filed on Oct. 13, 1993, abandoned.

This invention relates to an apparatus for changing a lap. More particularly, this invention relates to an apparatus for receiving and forwarding a reserve lap roll to a working position in a lap processing machine.

As is known, various types of machines have been provided for the processing of laps. In such machines, a lap roll is usually situated in a working position for feeding a lap web to processing elements within the machine. In addition, provisions have been provided to hold a reserve lap in a standby position at a radial distance from a lap roll in the working position.

The provision of the reserve lap roll serves to reduce unnecessary down times in machines which process lap rolls, such as combing machines or ribbon lap machines. In this respect, there are usually several processing positions, for example, six or eight, arranged next to one another whereby the advancement of reserve laps to the processing positions may occur simultaneously or separately over time. For example, the combing machine E7/5 described in the Rieter Machine Works Ltd. brochure "Kammerei—Impressum 1403d-0991—printed in Switzerland"/ "Combing room—Imprint 1403d—0991—printed in Switzerland" allows the transfer of empty tubes by hand to a collection position for a tube removal conveying system and, thereafter, the transfer of individual reserve lap rolls manually to the respective working positions. This process, however, requires a considerable amount of time and, in the event of improper handling, this process can lead to damage to the outer lap layer.

Japanese Patent 63-27449 describes a device in which a reserve lap roll is kept in a standby position on an inclined rolling surface. In order to keep the reserve lap in the standby position, a plate is attached in the area of the inclined rolling surface and is pivotally mounted to be moved from a locked position to a release position by means of an adjusting mechanism. Below the rolling surface, a swivellable receiving means is provided for the empty tubes which are ejected backwardly by means of an ejecting device. In addition, the swivellable receiving means is connected with the adjusting mechanism for unlocking the pivoting plate. This means that before the reserve lap roll is released for rolling down to the working position, the empty tube is transferred downwardly to the receiving means through a passage provided between the rolling surface and the working position. However, this device has the disadvantage that the reserve position is arranged relatively far at the rear, i.e. at a distance far from the working position. This is necessary because the tube which is ejected rearwardly requires a certain amount of space for transfer to the receiving means. This device therefore requires a large amount of lateral space and also blocks access for maintenance operations on devices which are situated in the lower and rear areas of the combing machine. The relatively long rolling path which the reserve lap has to cover until reaching the working position may also lead to damage or deformations of the outer lap layer.

Japanese Patent 52-64823 discloses a more compact arrangement, with the reserve lap roll being held in a position closely adjacent to the working lap roll. The reserve lap roll is also held in its standby position by a swivellable plate and is arranged at a position that is higher than the working lap roll. This arrangement at a more elevated standby position enables the ejection of the empty tube rearwardly directly below the swivellable blocking plate. The disadvantage in this arrangement, however, is the advancement of the reserve lap via a guiding surface from a relatively elevated standby position to the working position. This means that during the rolling process, the mass of the reserve lap is highly accelerated and then has to be braked so as to prevent the lap roll from going beyond the working position. This process can either be carried out manually or by means of appropriate braking elements. However, this arrangement requires additional efforts both technically and with respect to timing. In addition, the possibility of damage to the outer lap layer is not excluded.

Further devices are known, e.g. from Japanese Patent 59-43386, in which a reserve lap roll is placed on a tiltable guiding surface. In this arrangement, however, special blocking and holding elements are required to prevent the inadvertent rolling off of the reserve lap roll in the forward direction and to ensure the rearward positioning of the reserve lap roll. Further, while this device may be used to ensure a careful transfer of the reserve lap roll to the working position, the automatic rearward advancement of the empty tube is not solved.

Accordingly, it is an object of the invention to provide a relatively simple technique for receiving and advancing a reserve lap roll from a reserve position to a working position.

It is another object of the invention to provide for a careful of transfer of a lap roll from a reserve position to a working position while providing for an easy and automatic removal of an empty tube from the working position.

It is another object of the invention to provide a means for moving a reserve lap roll from a reserve position to a working position on a lap processing machine in a simple controlled manner.

Briefly, the invention provides a means for moving a reserve lap roll from a reserve position on a lap processing machine to a working position wherein the moving means is pivotally mounted to move the reserve lap roll from the reserve position towards the working position during pivoting of the moving means.

In one embodiment, the means for moving the reserve lap roll includes a trough which receives at least one reserve lap roll therein. In this respect, the trough may be used for supplying a multiplicity of reserve lap rolls to a multiplicity of working positions for the processing machine.

In addition, the moving means includes at least a pair of arms which are secured to the trough and which are pivotally mounted on a common pivot axis. In addition, a piston and cylinder unit or the like is pivotally connected to and between at least one of the arms and the lap processing machine for pivoting the arms about the common pivot axis.

In this embodiment, the pivotally mounted arms are horizontally spaced apart a distance greater than the length of a tube of a lap roll in the working position to permit passage of the tube therebetween prior to movement of a lap roll from the reserve position to the working position. In this way, the tube of the exhausted lap roll in the working position can be readily removed or ejected to a position under the reserve position prior to movement of the reserve lap roll into the working position.

This embodiment further includes at least one blocking element for selectively blocking movement of the pivotally mounted arms towards the working position. This blocking element may be in the form of a bar which blocks movement of an arm towards the working position or in the form of a hooked rod for restraining movement of an arm towards the working position. Further, the trough may be arranged to support the reserve lap roll with the center of mass of the reserve lap roll located in a vertical plane between the common pivot axis and the working position.

In another embodiment, the trough may support the reserve lap roll with the center of mass of the reserve lap roll located in a vertical plane on a side of the common pivot axis which is away from the working position. In this case, a blocking element is disposed on the same side of the pivot axis for arresting movement of the arms away from the working position.

The use of a trough to support the lap roll enables the lap roll to maintain a secure position in the reserve or standby position while at the same time permitting the lap roll to be carefully transferred to the working position. This means that the trough can be arranged in such a way that during the swivelling process in the direction towards the working position, the lap roll is gently carried towards the working position with only a short rolling path having to be covered by the lap roll to move from the trough into the working position. In this manner, an increased acceleration of the lap roll during the transfer process is prevented and a careful transfer is insured.

In still another embodiment, the trough may be mounted on at least one pair of parallel guide rods which are pivotally secured to and between the trough and the processing machine for guiding the trough in an arcuate path. In this respect, the guide rods define a parallelogram arrangement and lead to a precise adaptation of the trough to a careful transfer process.

In this embodiment, a piston and cylinder unit may be pivotally connected to and between at least one of the guide rods and the lap processing machine for pivoting the guide rods and, thus, the trough. In addition, a blocking element may be provided for selectively blocking movement of the guide rods towards the working position.

In still another embodiment, the means for moving the reserve lap roll may include a pair of arms which are pivotally mounted on a common pivot axis with each arm having holding means for engaging within a tube of a reserve lap roll in order to hold the reserve lap roll in the reserve position. In addition, a piston and cylinder unit is pivotally connected to and between at least one of the arms and the lap processing machine for pivoting the arms about the common pivot axis. In this embodiment, the arms serve to move the reserve lap roll directly from the reserve position to the working position in a controlled manner against the force of gravity.

This latter embodiment also enables a careful transfer of the reserve lap roll to the working position due to the movement of the reserve lap roll in the reserve position directly into the working position. Thus, the radial distance between the pivot axis and the central axis of the lap roll is the same in both the reserve position and the working position.

Each arm may also be provided with a recess located in order to provide an access opening to the interior of the tube of an engaged reserve lap roll. This ensures the cooperation of the moving means with a conveying device acting above the reserve position whereby gripper arms of the conveying device are provided with a free space for engagement in the tube of the reserve lap roll during transfer to the arms of the moving means. This ensures an easy decoupling of the gripper elements of the conveying device and an easy transfer to the reserve position. In this embodiment, both arms are movably mounted laterally relative to each other and suitable means are provided for moving the arms toward and away from each other to selectively engage and release a reserve lap roll therebetween. This further ensures a careful transfer and advancement of the reserve lap.

The various embodiments noted above ensure a compact arrangement and allow an automatic discharge of the tube of an empty lap roll from the working position. This is ensured, in particular, when at least a partial area of the clear horizontal distance of the pivotal arms is larger than the length of the tube being ejected.

Of note, the pivoting or swivelling movement of a pivot element may occur through a cylinder articulated on the swivelling element. For example, pneumatic cylinders may be used in this arrangement by means of which a careful transfer process may be carried out.

The use of the blocking elements prevents any inadvertent transfer process which might occur, for example, when a defect occurs in a pneumatic circuit for actuating the piston and cylinder units such as a leak.

By providing a pertinent articulation of the pivoting points of the swivelling elements on the machine, it is possible to position the center of mass of the reserve lap roll situated in the reserve position in such a way that a pivoting moment arises from this position in the direction towards the working position. In this way, the direction of transfer is precisely defined and the pivoting movement is supported by the weight of the reserve lap roll.

In order to prevent an undesirable acceleration of the swivelling process, it is preferable to dampen this process by attaching a damping element, e.g. a throttle in the pneumatic circuit to the piston and cylinder unit. A damping element may also be provided by attaching a pressure or tension spring in an appropriate manner.

A further option consists of providing a pertinent articulation of the pivoting elements, whereby the center of mass of the reserve lap is held in the reserve position in such a way that a pivoting moment arises which is opposite to the working position. In order to keep the reserve lap roll in this position, a stop is placed in the swivelling zone of the swivelling elements or the trough which stops the reserve lap roll in the reserve position. The provisions of this arrangement allows omitting the attachment of a mechanical blocking element.

To provide a full automation of the changing process, an ejecting device for the empty tube is allocated to the working position. In addition, the tube is transferred to a receiving means below the reserve position. The transfer may be supported by the attachment of a downwardly inclined guiding surface which is in communication with the working position.

Similarly, it is possible to rearwardly transfer the tube by means of arms which are held swivellably and which are provided with movable gripper elements, whereby the tube, placed on the downwardly inclined guiding surface, reaches the receiving means.

In this respect, it is proposed to provide stops for releasing the tube from the swivellably held arms, which stops force the gripper elements into a release position.

Usually several processing positions with working positions and standby positions are provided next to one another. Thus, several adjacent swivelling elements may be pivoted by means of a common adjusting member which is connected to the swivelling elements.

These and other objects and advantages of the invention will become more apparent from the following detailed description taken in conjunction with the accompanying drawings wherein:

FIG. 1 schematically illustrates a side view of a lap processing machine provided with a means for moving a reserve lap roll from a reserve position to a working position in accordance with the invention;

Figure 1:
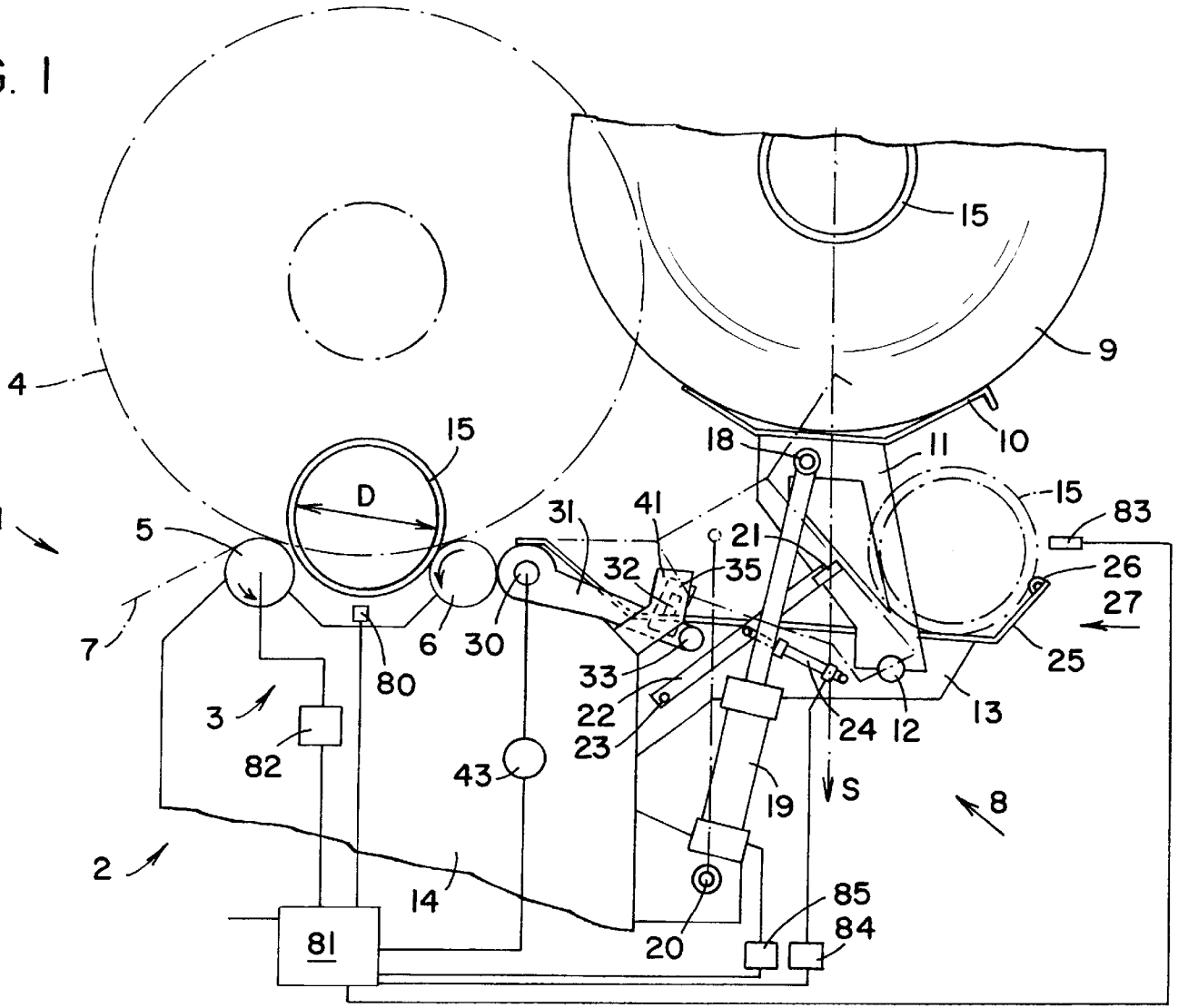

Referring to FIG. 1, the lap processing machine is in the form of a combing machine 1 having a combing head 2 with a working position in the form of a lap take-up position 3 in which a lap roll 4 (shown in broken lines) rests on a pair of take-up rollers 5, 6. At least one of the take-up rollers 5, 6 is provided with a drive 82 and thus ensures the unreeling of the lap roll 4. The unreeled web 7 shown in the dot-dash line is advanced to a nipper arrangement (not shown) which delivers the lap to a round comb (not shown) for combing. Such a device is known, for example, from EP-A-437807.

Usually, eight such combing heads 2 are arranged next to one another in a combing machine 1. The embodiment shall be described on the basis of one combing head 2.

As shown, the machine 1 also has a reserve or standby position 8 in which a reserve lap roll 9 is provided.

A means is also provided for moving the reserve lap roll 9 from the reserve position to the winding position. As indicated, this means is characterized in being pivotally mounted to move the reserve lap roll 9 from the reserve position towards the working position during pivoting of the moving means. As illustrated, this means includes a trough 10 which receives the reserve lap roll 9 therein. This trough 10 also extends over the length of four combing heads 2, for example. In this case, a total of four reserve laps 9 can be received simultaneously by the trough 10.

The trough 10 is swivellably held about a pivot axis of an axle 12 through swivelling arms 11. As shown in FIG. 1, each arm 11 is secured at one end to the trough 10 and is pivotally mounted at the opposite end about a pivot axis of the axle 12 which, in turn, is spaced from and below the trough 11. The axle 12 is fixed on a support 13 which is attached to a frame 14 of combing machine 1.

Figure 3:
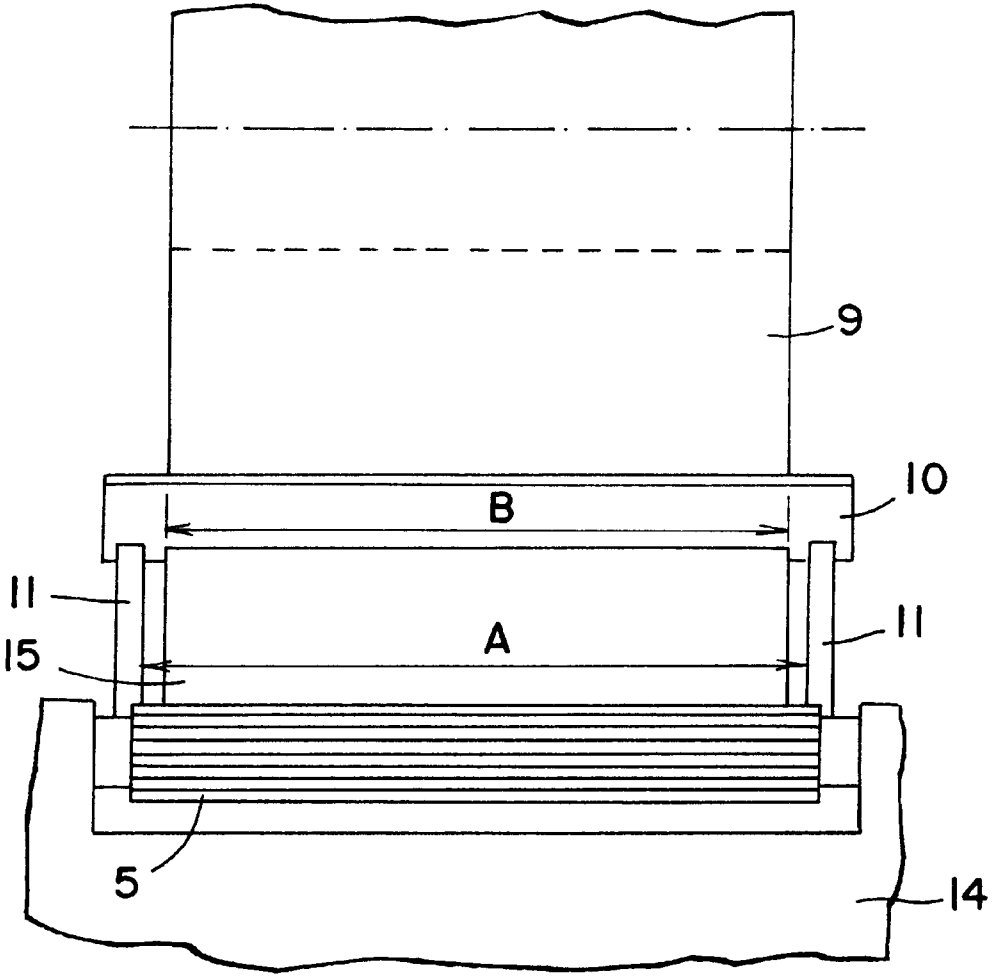
FIG. 3 illustrates a partial front view of the arrangement of FIG. 1 for moving the reserve lap roll in accordance with the invention.

As can be seen in the front view in accordance with FIG. 3, the distance A between the two swivelling arms 11 is selected in such a way that the passage of an empty tube 15 with a width B of an emptied lap roll is ensured between the swivelling arms 11.

A piston and cylinder unit 19, such as pneumatic unit, is pivotally connected to and between at least one of the arms 11 and the lap processing machine 1 for pivoting the arms 11 about the common axle 12. As indicated, the piston and cylinder unit 19 is connected to and between a bolt 18 on one arm 11 and to a bolt 20 on the frame 14.

As indicated, at least one arm 11 carries a stop 21 which cooperates with a blocking element 22 which is pivotally mounted via a pin 23 on the frame 14 of the machine 1. This blocking element 22 serves to selectively block movement of the arms 11 towards the working position. As indicated, the blocking element 22 is in the form of a rod which is actuated via a piston and cylinder unit 24 articulated to and between the rod 22 and the support 13. This piston cylinder unit 24 can be pneumatically actuated or otherwise actuated in the same manner as the piston and cylinder unit 19.

A guiding plate 25 is attached to the support 13 and extends up to the lap take-up roll 6 and forms a rearwardly inclined rolling surface for an emptied tube 15. The guiding plate 25 is angular at the rear end and provided with a stop 26 which is used as a damping element for braking the rearwardly rolling tube 15 and which may be made from foam or rubber. The rear part of the guiding plate 25 forms a kind of receiving means in the form of a trough 27 for the rearwardly ejected tube 15. As illustrated, the forward part of the guiding plate 25 forms an incline and guide surface between the working position and the guiding plate 25 for guiding a tube thereon to the rear part of the guiding plate 25.

In the position as shown in FIG. 1, the emptied tube 15 is situated on the take-up rollers 5, 6 and can be transferred rearwardly to the guiding plate 25 by an ejecting device in the form of two gripper arms 31 which are distanced from one another on a rotational axle 30. The gripper arm 31 which is swivellably arranged in the zone of the front side of tube 15 is provided with a holding means in the form of a moveable gripper element or lock 32 pivotable in the direction of the interior of the tube 15. This lock 32 carries out the transfer of the tube 15 in cooperation with a conical bolt 33 which is also attached to the gripper arm 31. The bolt 33 could also be arranged as a rotatably held roll which carries out an additional function for pressing the tube 15 on the take-up rollers 5, 6 through its external circumferential surface. The pressing of the tube 15 is required in accordance with the example of the EP-A1 455171 for detaching or preparing the outgoing web for a new joining process of a new lap.

Figure 6:
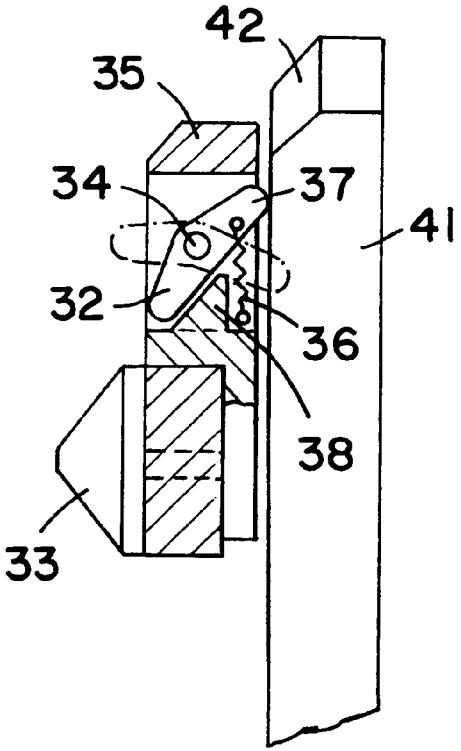
FIG. 6 illustrates a view of the gripper and stop arrangement of FIG. 5 taken in the direction indicated by the arrow X.
Figure 5:
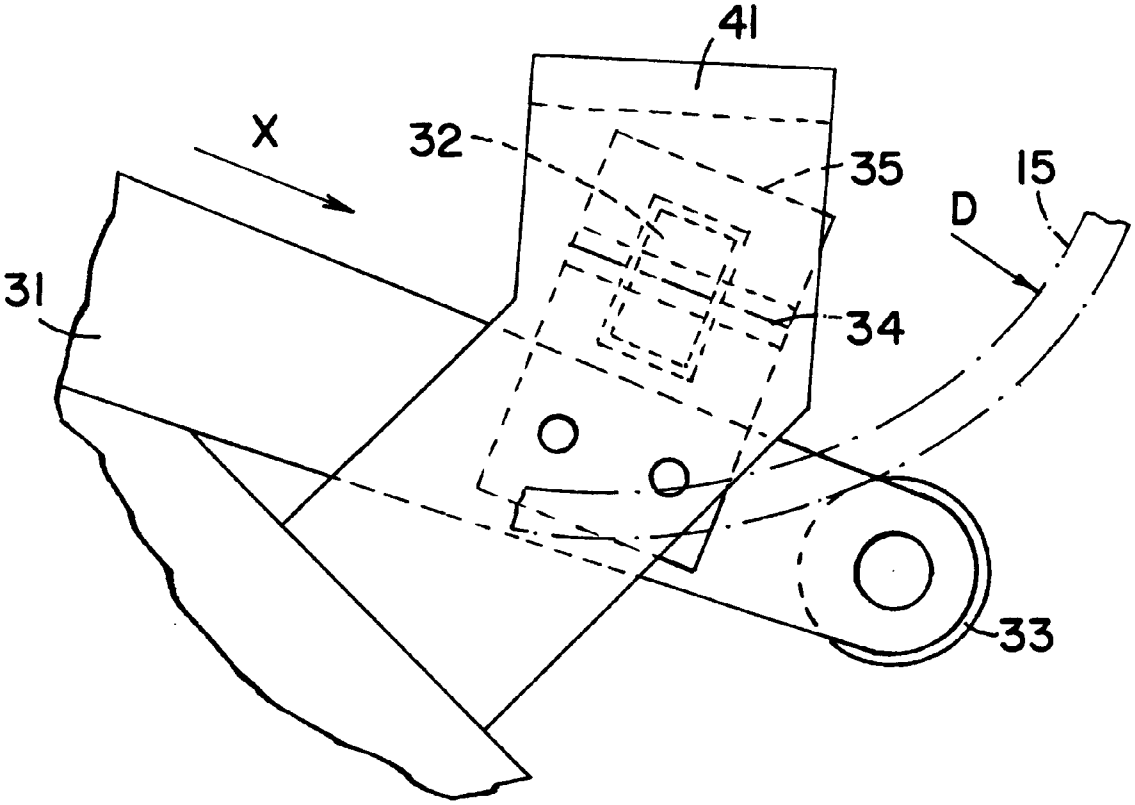
FIG. 5 illustrates an enlarged view of a gripper and stop arrangement for an ejecting device used in the embodiment of FIG. 1 in accordance with the invention.

Referring to FIGS. 5 and 6, the lock 32 is held on a pivot pin 34 of a bearing element 35 attached to the gripper arm 31. A spring 36, which is articulated on the bearing element 35 and an arm 37 of the lock 32, is used to produce a clockwise pivoting movement of the lock 32. The lock 32 can swivel until its arm 37 rests on a stop 38 of the bearing element 35. In the example as shown, the lock 32 is situated in an external engagement position, in which the lock 32 is held by a stop 41 attached to the frame 14. This means that as soon as the arm 37 of the lock 32 arrives at an inclination 42 of the stop 41 during the pivoting movement of the gripper arm 31, the arm is swivelled counter-clockwise, as viewed, against the force of the spring 36 out of the zone of the inside diameter D of the tube 15.

This process occurs simultaneously in the gripper arms 31 grasping the tube 15.

The engagement position of the lock 32 for the tube 15 is shown in a dot-dash line.

Shortly before transfer to the guiding plate 25, the tube 15 (as is shown in a dot-dash line in FIG. 5) rests on the bolt 33 due to gravity. When the gripper arms 31 continue to pivot downwardly, the tube 15 comes to rest on the guiding plate 25 and can subsequently roll backwardly into the receiving trough 27 due to the external engagement position of the lock 32.

The pivoting movement of the gripper arms 31 is produced by a schematically shown drive 43.

For example, this drive 43 may consist of a motor which is connected through gear elements with the rotational axle 30. Another solution for pivoting the gripper arms 31 could be achieved by attaching additional pivot elements on the rotational axle 30 which can be pivoted by a cylinder.

Figure 2:
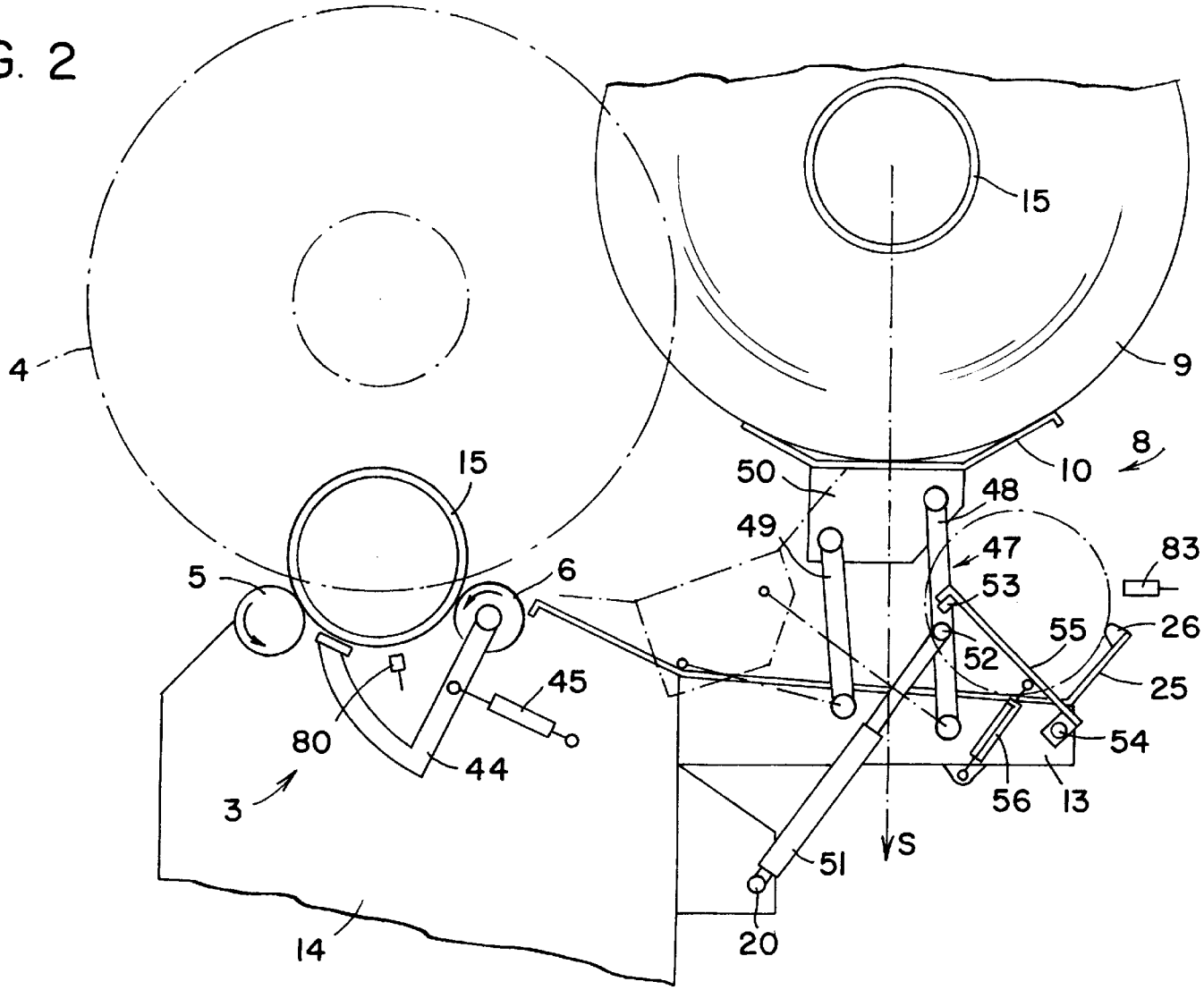
FIG. 2 illustrates a view of a modified arrangement employing a parallelogram arrangement for moving a reserve lap roll to a working position in accordance with the invention.

For rearwardly ejecting the tube 15, it is also possible to use a tube ejecting device 44 in accordance with the embodiment of FIG. 2. In this embodiment, the ejecting device 44 is rotatably held about the take-up roller 6 and is swivelled from its position through a piston and cylinder unit 45 which is articulated, on the one hand, on frame 14 and, on the other hand, on the ejecting device 44.

Referring to FIG. 2, wherein like reference characters indicate like parts as above, the means for moving the reserve lap roll 9 from the reserve position to the winding position employs a parallelogram 47 having a pair of parallel guide rods 48, 49 of different length which are swivellably held at one end on the support 13 and at their other end on a plate 50 attached to the trough 10. In the example shown, a piston and cylinder unit 51 acts on the guide rod 48 via a pivot axle 52, whereas the other end is articulated on the pivot axle 20. A stop 53 is additionally attached to the guide rod 48, which stop 53 is engaged by a lock 55 swivellable about a rotational axle 54. The lock 55 is swivellable via a cylinder unit 56 which is swivellably attached to the support 13.

As shown in FIG. 2, the trough 10 supports the reserve lap roll 9 with the center of mass of the lap roll located in a vertical plane which is between the pivot axis of the rearmost guide rod 48 and the working position so that the weight of the reserve lap roll 9 biases the lap roll 9 in the direction of the working position 3. As in FIG. 1, the guide rods 48, 49 on the opposite sides of the trough 10 are arranged at a clear distance between the respective pairs of guide rods as to permit passage of an empty tube 15 therebetween.

Figure 4:
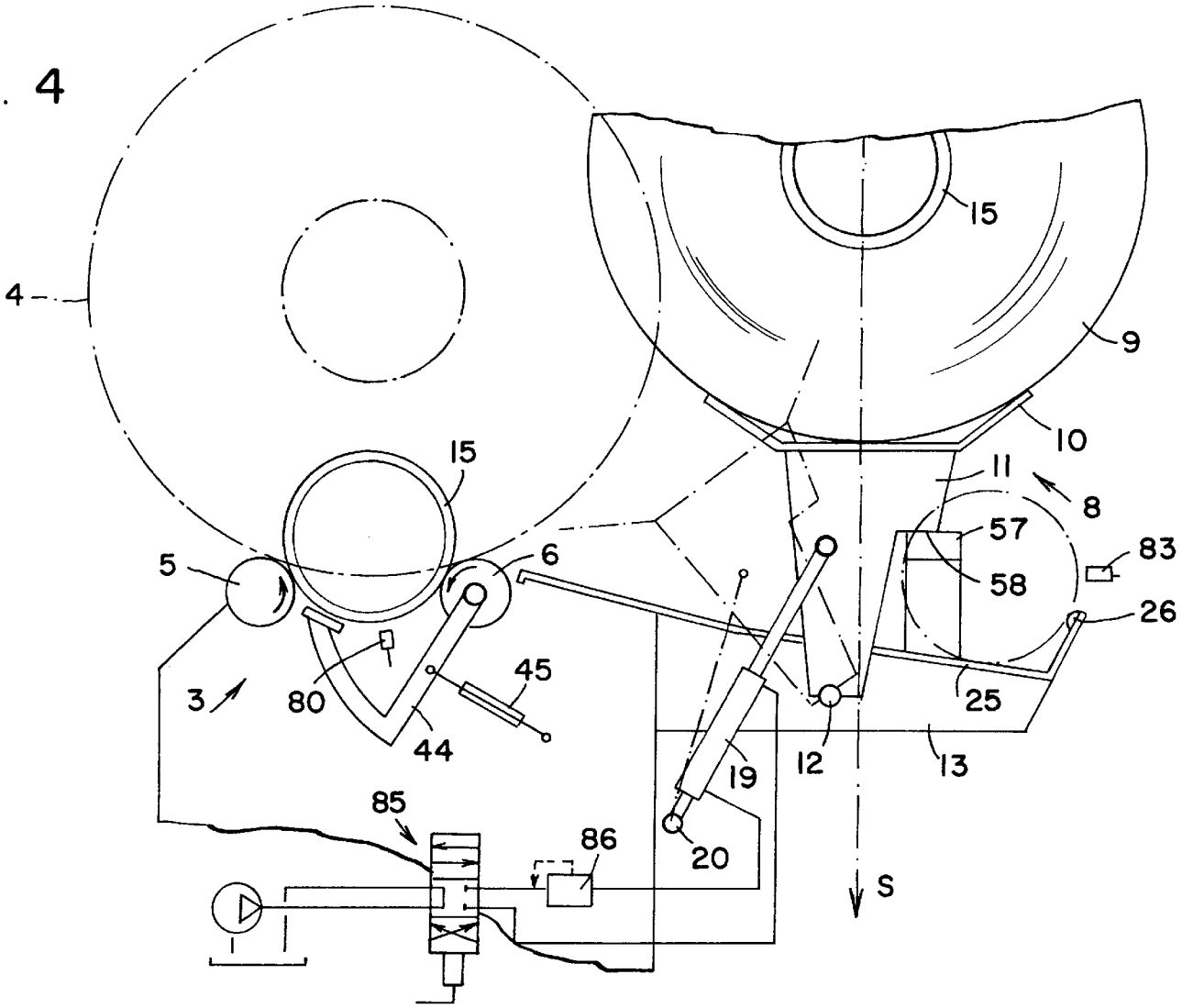
FIG. 4 illustrates a view similar to FIG. 1 of a further embodiment of a means for moving a reserve lap roll to a winding position in accordance with the invention.

Referring to FIG. 4, wherein like reference characters indicate like parts as above, the trough 10 may also be used to support the reserve lap roll 9 with the center of mass of the reserve lap roll located in a vertical plane on a side of the common pivot axis of the axle 12 away from the working position 3. In this embodiment, a blocking element 57 in the form of a stop is provided on the same side for arresting movement of the arms 11 away from the working position 3.

In this embodiment, the reserve lap roll 9 biases the trough 10 away from the working position 3. However, this embodiment allows the omission of the attachment of special locking elements without endangering the stable and secure reserve position 8.

Figure 7:
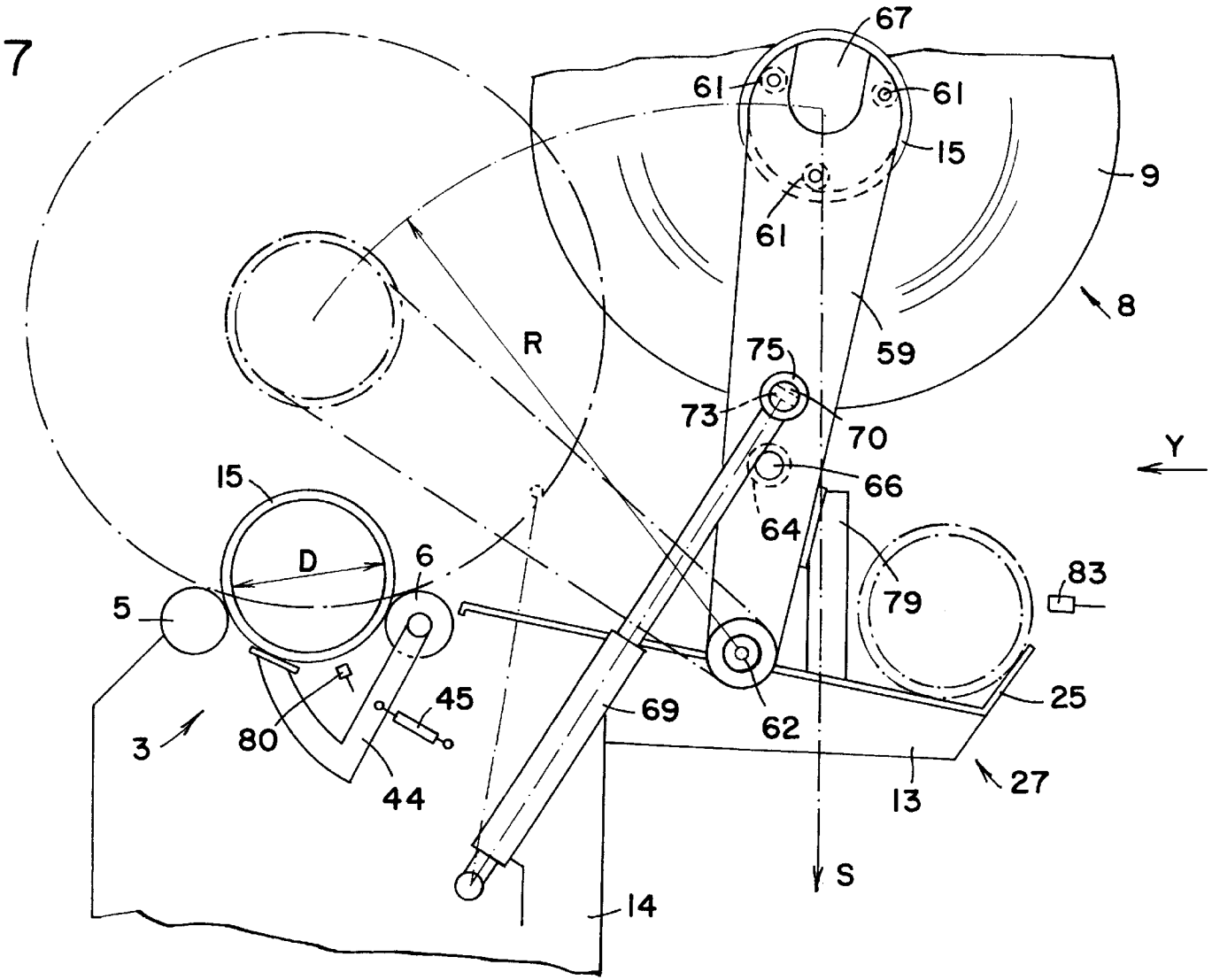
FIG. 7 illustrates a further view similar to FIG. 1 of a further embodiment employing a pair of pivotally mounted arms for moving a reserve lap roll directly to a working position in accordance with the invention.
Figure 8:
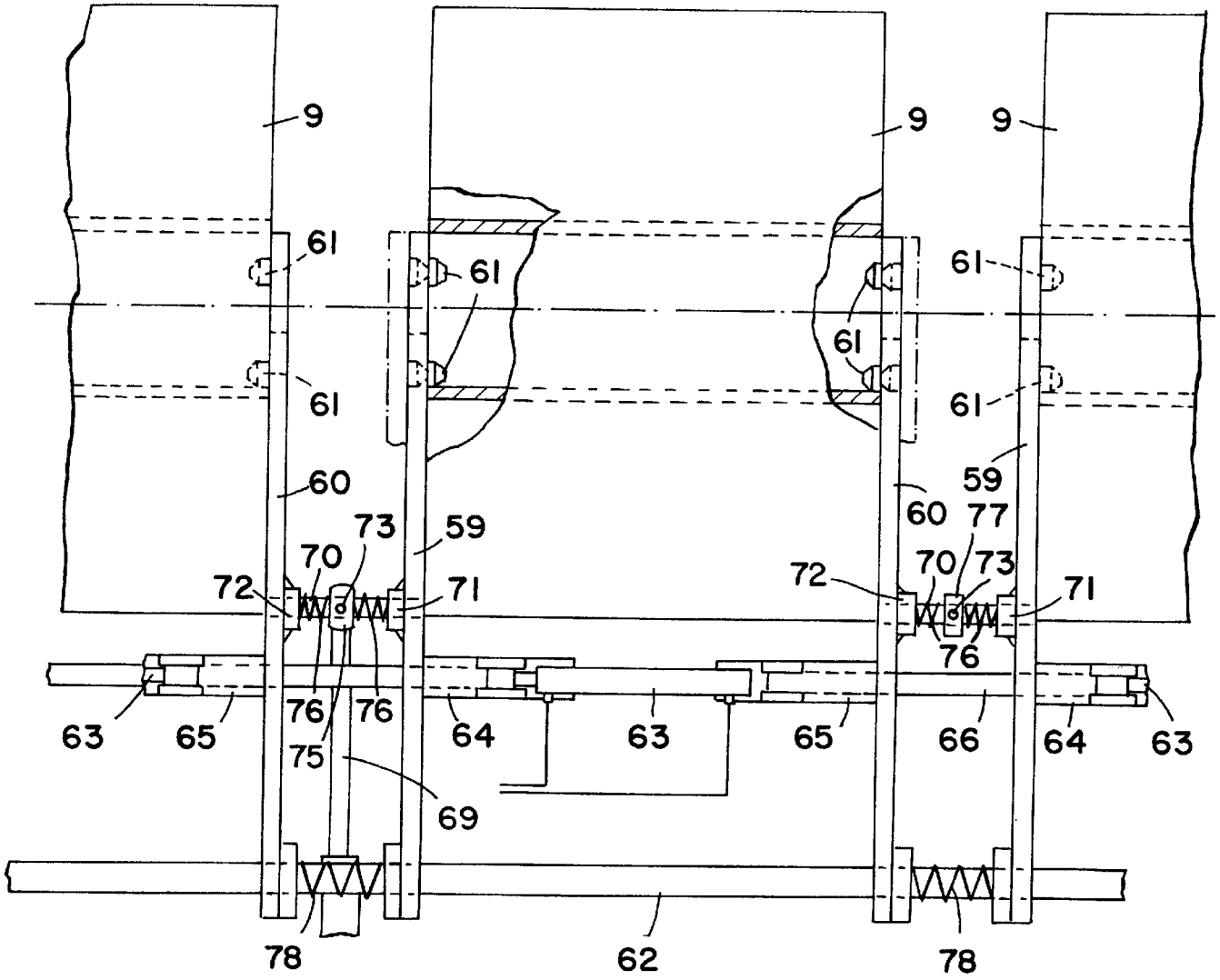
FIG. 8 illustrates a front view of the arrangement of FIG. 7 taken in the direction indicated by the arrow Y.

Referring to FIGS. 7 and 8, wherein like reference characters indicate like parts as above, the means for moving the reserve lap roll 9 may be in the form of a pair of arms 59, 60 which are pivotally mounted on a common pivot axis of an axle 62 in order to move the reserve lap roll 9 directly from a reserve position to the working position on the take-up rollers 5, 6.

As is shown in FIG. 8, each arm 59, 60 includes a plurality of holding means 61 for engaging within a tube 15 of a reserve lap roll 9 in the reserve position in order to hold the reserve lap roll 9 in the reserve position. Each holding means 61 is in the form of a centering roller provided with a conical tip.

As indicated in FIG. 8, the pivot arms 59, 60 are movably mounted relative to each other so that the distance A between the arms 59, 60 can be increased for receiving or transferring the reserve lap roll 9. To this end, a means for moving the arms 59, 60 toward and away from each other to selectively engage and release a reserve lap roll 9 includes a piston and cylinder unit 63 which is connected, on the one hand, to a guide tube 65 connected to one arm 59 and, on the other hand, to a guide tube 65 connected with the other arm 60. The guide tubes 65, 65 are guided on a shaft 66 extending along the machine. In addition, a piston and cylinder unit 69 acts on a shaft 70 which projects into an attachment 71, 72 of the pivot arms 59, 60. Each receptacle or attachment 71, 72 for the shaft 70 is arranged in such a way that a horizontal displacing movement of the arms 59, 60 is possible on the shaft 70. The shaft 70 is rigidly connected with the piston rod of the cylinder unit 69 via a pin 73. To ensure that the distance between the pivoting arms 59, 60 is maintained precisely, pressure springs 76 are coaxially attached on the shaft 70 between the attachments 71, 72 and the bearing element 76 of the cylinder unit 69. At the position where there is no cylinder 69 or a bearing element 75, a spacer 77 is attached on the shaft 70 through the pin 73.

As indicated in FIG. 8, springs 78 may also be provided about the axle 62 to bias the arms 59, 60 towards each other.

As indicated in FIG. 7, each arm 59, 60 is provided with a recess 67 within the holding element 61 in order to provide access to the interior of the tube 15 of the lap roll 9. This allows other conveying equipment to be able to grip the end of the lap roll 9 for transferring to the arms 59, 60.

As also shown in FIG. 7, the center of mass of the lap roll 9 is disposed in a vertical plane on a side of the axle 62 away from the working position 3. Thus, in order to keep the reserve lap roll 9 in the reserve position, a stop 79 is mounted on the support 13 of the frame 14 of the machine to arrest movement of at least one of the arms 59, 60 away from the working position. Thus, the fixed reserve position can be obtained without need for special locking elements.

The operation of the various embodiments is similar. Accordingly, only the operation of the embodiment illustrated in FIG. 1 will be discussed in detail.

Referring to FIG. 1, during operation, a sensor 80 allocated to the working position 3 issues a signal "tube empty" to a control unit 81 in the position as shown in the drawing. The control unit 81 then stops the drive of the combing machine (not shown) and the drive 82 of the take-up roller 5. Thereafter, the drive 43 of the gripper arms 31 is activated through the control unit 81, with the lock 32 impinging on the circumferential surface of the tube 15. The locks 32 situated to the left and the right of the front side of the tube 15 are swivelled into the bearing element 35 against the force of the springs 36 when the swivelling is continued. As soon as the free leg of the lock 32 reaches the inside of the tube 15, it is transferred to the locking position shown in dot-dash lines in FIG. 6. The tube wall is now situated between the circumferential surface of the bolt 33 and the lock 32. The direction of rotation of the drive 43 is now reversed, whereupon the tube 15 is swivelled from the working position 3 rearwardly in the direction of the guide plate 25.

Shortly before the tube 15 impinges on the guide surface 25 with its external surface, the lock 32 comes into the zone of inclination 42 of the stop 41 and is swivelled inwardly into the bearing element 35. During the swivelling movement ofthe pivot arms 31, the external surface of the tube 15 has come to lie on the external surface of the respective bolt 33 (shown in FIG. 5 by the dot-dash line). When the swivelling arms are further swivelled downwardly and laterally past the guide plate 25, the tube 15 comes to rest on the guide plate 25 and rolls below the trough 10 between the swivelling arms 11 into the rear receiving trough 27. The rolling process is dampened by the attached stop 26. A sensor 83 detects that the tube 15 has reached this position and issues a signal to the central control unit 81. In this way, the actual transfer process of the reserve lap roll 9 to the working position 3 is initiated.

This means that the cylinder unit 24 is actuated via a valve 84, whereby the lock 22 is transferred to a release position and thus enables the swivelling process of swivelling arms 11. The swivelling process in the direction of the working position 3 is carried out by the weight of the reserve lap 9 by using cylinder 19 which is controlled through a valve 85. The trough 10 thus reaches the position as shown in the dot-dash line, whereupon the reserve lap 9 is then rolled into the working position 3. The trough 10 is arranged in such a way that the rolling and the transfer to the working position 3 occurs carefully. The reserve lap roll 9 thus converts into the working lap roll 4, which is shown in the dot-dash line. The new web of working lap can now be joined to the outgoing web either by hand or automatically.

As the trough 10 is still in the position as shown in the dot-dash line, a conveying unit can be positioned above the receiving trough 27 which upwardly carries off and discharges the empty tubes 15 from the receiving trough 27 by means of respective gripper elements (not shown). As soon as this process is completed (which is again monitored by sensor 83), the receiving trough 10 is transferred to the reserve position 8 by means of the cylinder unit 19. The lock 22 is then brought to the locking position as shown herein through cylinder unit 24. In this way, the reserve position is mechanically locked.

As can be seen in FIG. 1, the working lap roll 4 and the reserve lap roll 9 would overlap in case of full laps. That is why a new reserve lap 9 will only be placed on the trough 10 by the conveying system when the working lap roll 4 has been reduced to a certain minimum diameter. This can either occur through a respective timer or through respective sensors. Such sensors are described, for example, in DE-OS 38 36 242.

In order to dampen the lowering speed of the reserve lap to the working position 3, it is possible (as is shown in FIG. 4) to provide a damping element 86 in the control unit of cylinder unit 19.

The transfer process of the reserve lap roll 9 of the embodiment in accordance with FIGS. 2 and 4 is substantially equivalent to the embodiment of FIG. 1. The only difference is that an ejecting device 44 is provided for the ejection of the emptied tubes 15 below the take-up rollers 5, 6 by means of which the tube 15 is rearwardly transferred to the area of the guiding surface 25 by the actuating cylinder 45. In contrast to the embodiment in accordance with FIG. 1, the lock 55 is arranged in the embodiment of FIG. 2 as a kind of catch which places itself in the standby position over a stop 53.

By attaching the pivot axle 12 in a pertinent manner as shown in the embodiment of FIG. 4, no special locking mechanism is required for securing the reserve position 8. The position of the line of the center of mass S behind the pivot axle 12 produces a torsional moment against the working position 3. This torsional moment is taken up by the attachment of a stop 57, on which a bearing surface 58 of the swivelling arm 11 comes to rest. This means that a further rearward swivelling movement is prevented. The swivelling of the reserve lap roll 9 to the working position 3 is substantially equivalent to the process as shown in the embodiment of FIG. 1, whereby only during the beginning of the swivelling process, the swivelling moment acting rearwardly has to be overcome by means of cylinder unit 19.

In the embodiment in accordance with FIGS. 7 and 8, the ejection of a tube 15 in the working position 3 is transmitted to the control unit via a sensor 80 in accordance with the embodiment of FIG. 1. This initiates the ejecting process of the empty tube through the ejecting device 44, which is actuated via the cylinder 45. Tube 15 reaches the sloping guide plate 25 and rolls into the receiving trough 27. Sensor 83 informs the control unit when the tube 15 lies in this trough 27. The control unit then initiates the transfer process of the reserve lap roll 9 to the working position 3. Cylinder 69 is thus activated and swivels the reserve lap roll 9 forwardly to the working position 3 shown in the dot-dash line. This lowering process can be dampened according to the embodiment of FIG. 3 by a damping element. By activating the individual cylinders 63, the respectively cooperating swivelling arms 59, 60 are pushed apart horizontally by a certain magnitude, whereby the centering rollers 61, as is shown in FIG. 8 in dot-dash line, leave the zone of the inside of the tube 15. The reserve lap roll 9, which now becomes the working lap roll 4, now rests freely on the take-up rollers 5, 6. The swivelling arms 59, 60 now reach the standby position 8 in the opposite direction after activating cylinder 69 where they come to rest on the stop 79.

The conveying system for removing the empty tubes 15 and for making available new laps 9 can now carry off the empty tubes 15.

After the working lap has been processed up to a certain degree, as was already mentioned above, a new reserve lap can be made available for the respective working position. In the example shown, the new reserve lap roll is brought by a cantilever mounted conveying system to the level of the standby position 8 between the two swivelling arms 59, 60. By reverse activation of the cylinder unit 63, the two swivelling arms 59, 60 are displaced with respect to one another so that the centering rollers 61 move to the zone of the inside of the tube 15 of the reserve lap roll 9. As soon as this displacement has been completed, the gripper device (not shown) of the conveying system can be uncoupled so that the lap roll 9 is fully received by the swivelling arms 59, 60 or their centering rollers 61 for the transfer.

In the embodiment in accordance with FIG. 7, it would also be possible that the reserve lap roll 9 is taken directly from the loading platform of a lap conveying carriage by means of the swivelling arms 59, 60. The transfer of the empty tubes could also be made automatically by swinging down the rear edge of the guide plate 25. To enable this, it would only be necessary to change the swivelling mechanism through cylinder unit 69 and to arrange the rear surface of the guide plate 25 so that the plate 25 can swing down.

What is claimed is:

1. In combination, a lap processing machine having a working position for receiving and unwinding a lap roll thereat and a reserve position for receiving a reserve lap roll;

means for moving said reserve lap roll from said reserve position to said working position, said means being pivotally mounted to move with a received reserve lap roll thereon towards said working position to move the received reserve lap roll from said reserve position towards said working position in an arcuate manner during pivoting of said means;

said means includes a trough receiving at least one reserve lap roll therein and further includes at least a pair of arms secured to said trough and pivotally mounted on a common pivot axis and a piston and cylinder unit pivotally connected to and between at least one of said arms and said lap processing machine for pivoting said arms about said axis; and a blocking element for selectively blocking movement of said arms towards said working position.

2. The combination as set forth in claim 1 wherein said trough supports a reserve lap roll therein at said reserve position with a center of mass of the reserve lap roll located in a vertical plane located between said common pivot axis and said working position.

3. In combination, a lap processing machine having a working position for receiving and unwinding a lap roll thereat and a reserve position for receiving a reserve lap roll; and means for moving said reserve lap roll from said reserve position to said working position, said means being pivotally mounted to move with a received reserve lap roll thereon towards said working position to move the received reserve lap roll from said reserve position towards said working position in an arcuate manner during pivoting of said means;

wherein said reserve position is spaced from said working position a distance which would permit a reserve lap roll in said reserve position to overlap with a full lap roll in said working position.

* * * * *